US005253670A

United States Patent [19]

Perrott

[11] Patent Number: 5,253,670

[45] Date of Patent: Oct. 19, 1993

[54] MULTIPLE DRAIN TRAP PRIMER VALVE ASSEMBLY FOR SEWER LINES

[75] Inventor: Charles H. Perrott, Portland, Oreg.

[73] Assignee: C. H. Perrott, Inc., Portland, Oreg.

[21] Appl. No.: 990,026

[22] Filed: Dec. 14, 1992

[51] Int. Cl.[5] ..... E03C 1/296

[52] U.S. Cl. ..... 137/247.25; 137/561 A; 137/624.12; 137/360

[58] Field of Search ..... 137/247.25, 561 A, 624.11, 137/624.12, 360, 217; 138/30, 31, 44; 285/382.7

[56] References Cited

U.S. PATENT DOCUMENTS

| | | | |
|---|---|---|---|
| 815,691 | 3/1906 | Ericsson | 137/247.25 X |
| 1,186,812 | 6/1916 | McFerran | 285/382.7 X |
| 1,484,126 | 2/1924 | Gaspard | 137/624.11 X |
| 2,288,297 | 6/1942 | Naiman | 137/561 A |
| 3,333,597 | 8/1967 | Sullivan | 137/247.25 X |
| 3,633,627 | 1/1972 | Perrott et al. | 138/31 |
| 3,776,269 | 12/1973 | Watts | 137/561 A X |
| 3,864,938 | 2/1975 | Hayes, Jr. | 137/561 A X |
| 3,865,138 | 2/1975 | Jones | 137/624.12 |
| 4,351,360 | 9/1982 | Smyth | 137/624.12 |
| 4,462,423 | 7/1984 | Franklin, Jr. | 137/561 A |
| 4,589,435 | 5/1986 | Aldrich | 137/624.12 X |
| 4,712,574 | 12/1987 | Perrott | 137/217 |
| 4,807,664 | 2/1989 | Wilson et al. | 137/624.11 |
| 4,942,896 | 7/1990 | Slusser | 137/360 |

*Primary Examiner*—John Rivell

*Attorney, Agent, or Firm*—Eugene D. Farley

[57] ABSTRACT

A multiple drain trap primer valve assembly. The assembly comprises a plumbing conduit system including a house line 10 carrying water under pressure and a plurality of branch lines 12 each serving the drain trap 14 of a particular plumbing fixture. A manifold 26 having multiple discharge openings is connected into the house line. Coupling means 30 couple the branch lines to the manifold, one to each opening. Each coupling means includes a flow orifice 44 of size predetermined to equalize the flow of priming water to the branch line. Time-clock controlled valve means 20 is positioned in the house line to open it to the flow of water at predetermined time intervals.

6 Claims, 2 Drawing Sheets

MULTIPLE DRAIN TRAP PRIMER VALVE ASSEMBLY FOR SEWER LINES

This invention pertains to a primer valve assembly for distributing priming water to multiple sewer line water traps. It pertains particularly to such a valve assembly which is electronically controlled and adapted for installation as a compact unit between the studs of a conventional building structure.

BACKGROUND AND GENERAL STATEMENT OF THE INVENTION

As is well known, most municipal plumbing and sanitary codes require that means be provided for supplying water automatically to sewer line water traps. This ensures that the traps will be operative at all times.

The economical provision of such traps to service a multiple plumbing installation presents a problem to the contractor. Such installations occur for example in supermarkets where there may be 50 or 60 refrigerated display cases, each with its own drain to the sewer line. They may occur also in apartment houses and business buildings, where there are multiple sewer drains associated with a plurality of lavatories, laundry rooms etc.

It is the usual practice to stub off in the wall at some central point the tubing leading to cluster of such installations. It then is required to provide a connection to each of the plumbing units.

It is the general purpose of the present invention to provide a drain trap primer valve assembly for use in such a situation, in the connection of multiple drain traps to a source of priming water.

It is a particular purpose of the invention to provide such an assembly which is available as a low cost compact, unit characterized by ease of installation and inspection, efficiency of operation, and uniformity of priming water distribution to all of the plumbing units which it serves.

The foregoing and other purposes of the invention are accomplished by the provision of a plumbing conduit system including a house line carrying water under pressure and a plurality of branch lines, each serving the drain trap of a particular plumbing fixture. Connected into the house line is a manifold having a plurality of discharge openings, one for each branch line. A plurality of couplings couple the branch line to the manifold openings, one to each opening. Each coupling includes a flow orifice of a size predetermined to substantially equalize the flow of priming water to each branch line.

Upstream from the manifold in the house line there is provided a time-clock-controlled valve positioned for opening the house line to the flow of priming water to the branch lines at predetermined time intervals, thereby accomplishing the desired trap function of ensuring that all of the multiple traps are filled uniformly with water at all times.

THE DRAWINGS

DESCRIPTION OF A PREFERRED EMBODIMENT

Figure 1:
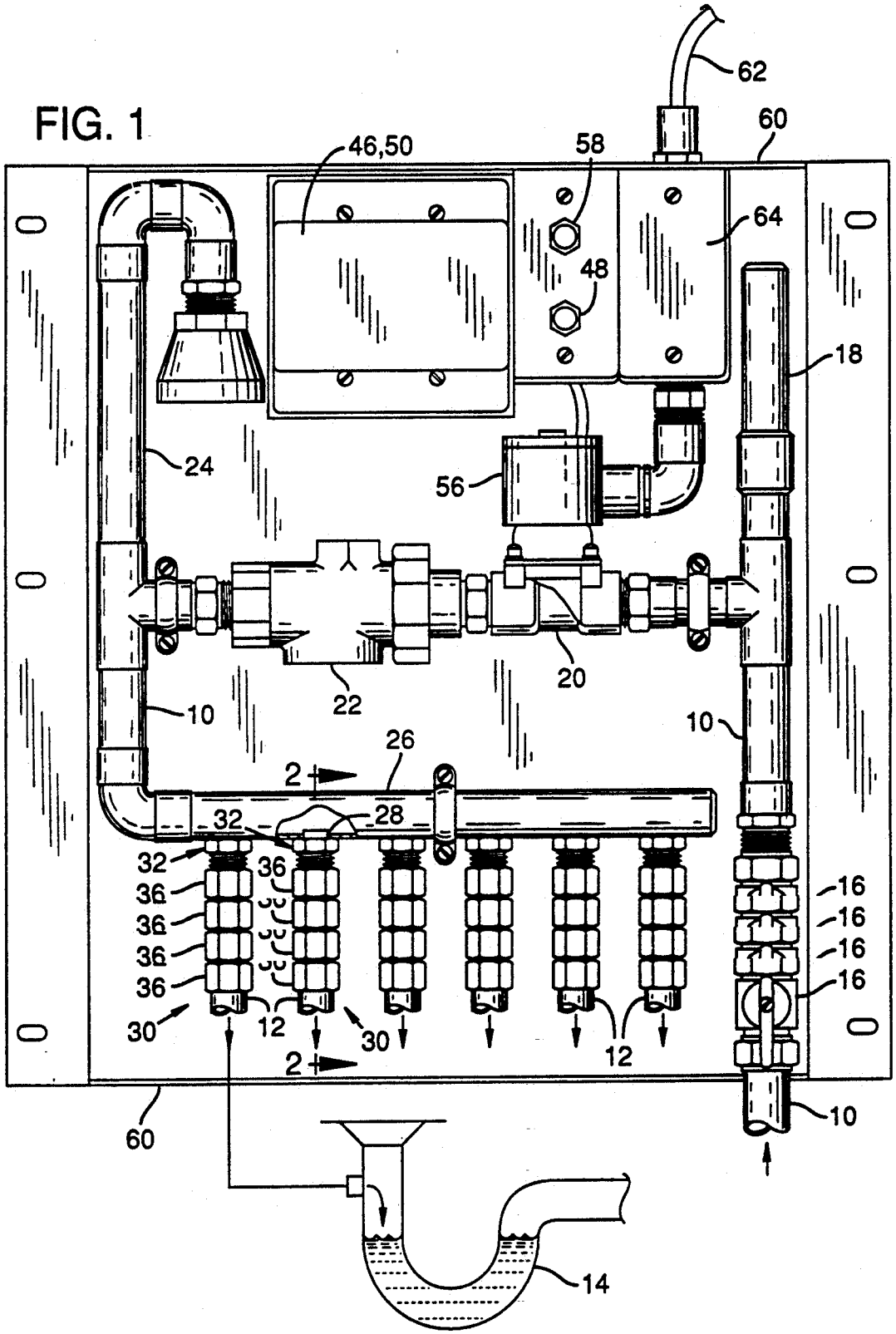
FIG. 1 is a schematic view of the herein described multiple drain trap primer valve assembly.

Referring to FIG. 1, the multiple drain trap primer valve assembly of my invention is adapted for connection into a house or main line 10 carrying domestic or commercial water under pressure. The assembly delivers the water in metered amounts at predetermined times to branch lines 12, each one of which is connected to a drain trap 14 associated with a plumbing fixture.

The flow of water into the assembly is controlled by master on/off valve 16.

A water hammer arrester 18 may be connected into the line, if necessary to control water hammer. This element of the assembly may be conventional in character, for example of the type described and illustrated in Perrott U.S. Pat. No. 3,633,627.

A primer control valve 20, of a type and having a function to be described below, next is coupled in series into house line 10.

Where necessary to prevent back-up of sewer gases into the system, a check valve 22 may be included in the line.

Next in series is vacuum breaker 24. This serves the usual function of preventing an inadvertent condition of vacuum in the plumbing system, resulting in contamination of house line 10 water with sewer water drawn up from traps 14. The vacuum breaker may be of any conventional construction, for example as illustrated and described in Perrott U.S. Pat. No. 4,712,574.

Downstream from vacuum breaker 24, house line 10 is coupled to a manifold 26. This component of the assembly is provided with a plurality of spaced discharge openings 28 along its length. The number of such openings corresponds to the number of branch lines 12 which the manifold is designed to serve. In practice, there usually are 4, 6 or 12 such openings.

In the operation of such a manifold, a problem is presented in arranging for the intermittent delivery of a small but uniform amount of primer water at intermittent time intervals to all of traps 14. The present invention provides a solution to this problem by the inclusion in the plumbing assembly of novel coupling means indicated generally at 30 and illustrated in detail in FIG. 2.

Each coupling means includes a novel primer watermetering element termed herein an "orifice fixture" 32, a compression washer 34, and a compression nut 36.

Orifice fixture 32 serves not only a coupling function, but also a metering function. It meters the flow of water from the pressure head existing in manifold 26 so that substantially equal amounts of water are discharged into branch lines 12 at each actuation of primer valve 20.

Orifice fixture 32 consists of an extension or neck 38, an angular flange 40, and a threaded extension 42, diametrically opposed to extension 38.

Extension 38 is designed and dimensioned for insertion into one of manifold openings 28, in which it is seated and to which it is sealed by appropriate means, for example by soldering.

Angular flange 40 is designed to be gripped by a wrench during fastening and unfastening of the coupling, to avoid disruption of the soldered connection.

Diametrically opposed threaded extension 42 is designed for threaded engagement with compression nut 36 as it is tightened down on compression washer 34 during coupling in sealed relation of tubing 12 to the manifold.

Orifice fitting 32 has therethrough a longitudinal bore terminating in the upstream end in an orifice 44. As noted above, this orifice is of predetermined size so that, when operating in conjunction with a plurality of similar elements of the assembly, all elements deliver water to the traps 14 which they serve in substantially equal amounts.

Figure 3:
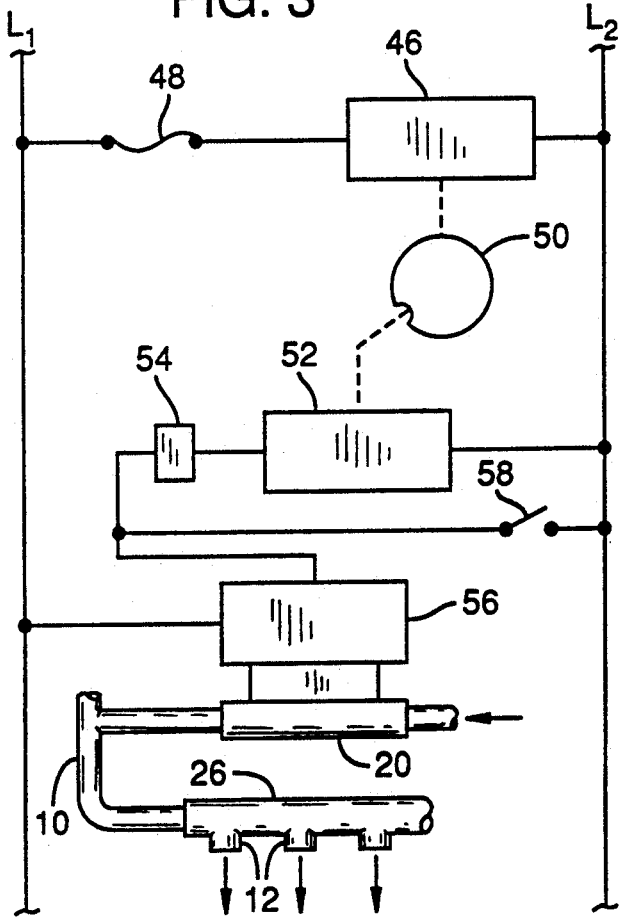
FIG. 3 is a schematic circuit diagram illustrating an electric circuit employed in the operation of the assembly of the invention.

To deliver primer water to the traps in the desired amount, at the desired time intervals, primer valve 20 preferably is actuated automatically by means of a time clock- controlled electronic drive. An appropriate arrangement is illustrated in FIG. 3.

Connected between house electric lines $L_1$ and $L_2$, in series circuit relationship, is a time clock 46 and fuse 48.

Time clock 46 drives a cam 50 which in turn is positioned for operation of primer valve switch 52.

Switch 52 is in a second circuit in series with time delay switch 54 and solenoid 56. Solenoid 56 actuates primer valve 20 for a time period dictated by time delay switch 54.

It is a feature of the invention that the assembly may be tested easily and efficiently from time to time, for example upon the arrival of a plumbing inspector, as required to confirm that it is delivering water in the required amount and at the required times to traps 14. To this end, there is included in the second electric circuit a bypass circuit which includes a test switch 58 as an override. Closing the switch will result in energization of solenoid 56 which in turn actuates primer valve 20 for the desired test period.

It is a further feature of the invention that all of the units of the assembly may be housed in a suitable case 60. There thus is formed a compact unitary assembly which may be mounted in the space between conventional studs, adjacent the location where branch lines 12 leading to the sewer traps are stubbed off in a structural wall.

OPERATION

The operation of the herein described multiple drain trap primer valve assembly is as follows:

Mounted in case 60, the assembly is nailed to the studs in its use location. House pressurized water line 10 is connected to main on/off valve 16.

Figure 2:
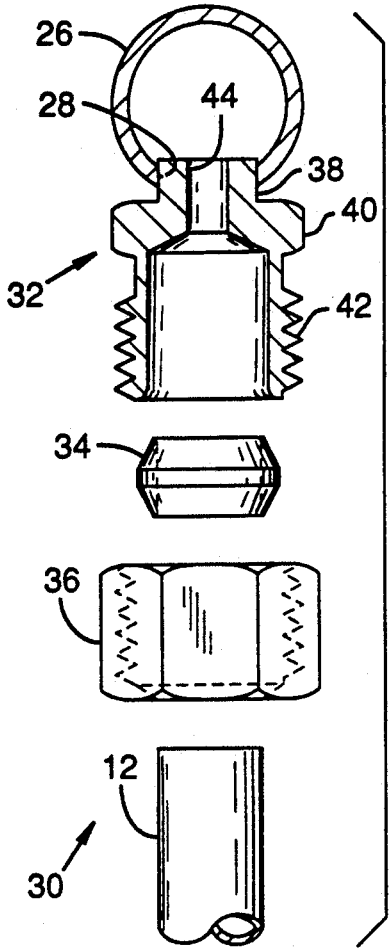
FIG. 2 is a fragmentary, detail exploded view, partly in section, taken along line 2—2 of FIG. 1, illustrating a metering coupling employed in the primer valve assembly of the invention for coupling the primer conduits to a central manifold distributor.

Branch lines 12, each connected to a sewer line trap 14, are coupled to manifold 26 using couplings 30 in the manner indicated in FIG. 2.

House electric line 62 is hard wired to junction box 64, thereby establishing the electric circuits required for operation of time clock 46, cam-operated primer valve switch 52, time delay 54, primer valve solenoid 56, and test switch 58. The time clock is set for the desired operating intervals, for example once every 24 hours. It thereupon will energize the solenoid at the selected time(s) for a period determined by the setting of time delay switch 54.

When it is desired to test the unit, for example during visits by the plumbing inspector, this may be accomplished easily without disturbing the setting of the time clock by use of override test switch 58.

Having thus described in detail preferred embodiments of the present invention, it will be apparent to those skilled in the art that various physical changes may be made in the device described herein without altering the inventive concepts and principles embodied. The present embodiment is therefore to be considered in all respects as illustrative and not restrictive, the scope of the invention being indicated by the appended claims. All changes which come within the meaning and range of equivalency of the claims are therefore to be embraced therein.

I claim:

1. A multiple drain trap primer valve assembly comprising in combination:

a) a plumbing conduit system including a house line 10 carrying water under pressure and a plurality of branch lines 12 each serving the drain trap 14 of a particular plumbing fixture, b) connected into the house line, manifold means 26 for receiving water under pressure from the house line and having a plurality of discharge openings 28, one for each branch line, c) a plurality of coupling means 30 for coupling the branch lines to the manifold openings, one to each opening, d) the coupling means each including a flow orifice 44 of size predetermined to substantially equalize the flow of priming water to each branch line 12, and e) in the house line, upstream from the manifold means, valve means 20 positioned for opening the house line to the manifold means to deliver water under pressure through the flow orifices to the branch lines for a predetermined timed period at predetermined timed intervals.

2. The multiple drain trap primer valve assembly of claim 1 wherein the valve means comprise time-clock-controlled valve means for controlling delivery of water pressure to the manifold means and branch lines for a predetermined timed period at predetermined timed intervals.

3. The multiple drain trap primer valve assembly of claim 1 wherein the valve means comprise electronically operated time clock control valve means for controlling delivery of water under pressure to the manifold means and branch lines for a predetermined timed period at predetermined timed intervals.

4. The multiple drain trap primer valve assembly of claim 1 wherein the valve means 20 comprises electrically operated, time clock-controlled valve means in a first electric circuit including an electric time clock 46-operated cam 50 and a second electric circuit including in series with electric switch means 52 positioned for operation by said cam, electric solenoid means 56 positioned for operation of the valve means for controlling delivery of water under pressure to the manifold means and branch lines for a predetermined timed period at predetermined timed intervals.

5. The multiple drain trap primer valve assembly of claim 4 wherein the electric switch means 52 comprises time delay electric switch means for controlling delivery of water under pressure to the manifold means and branch lines for a predetermined timed period.

6. The multiple drain trap primer valve assembly of claim 4 including a case 60 receiving the assembly components and dimensioned for reception between and fastening to the studs of a structural wall.

* * * * *